United States Patent [19]

Vidalis

[11] 4,336,753

[45] Jun. 29, 1982

[54] RUG PRINTING SYSTEM

[76] Inventor: Ted Vidalis, P.O. Box 1875, Dalton, Ga. 30720

[21] Appl. No.: 184,400

[22] Filed: Sep. 5, 1980

Related U.S. Application Data

[63] Continuation of Ser. No. 919,862, Jun. 28, 1978, abandoned.

[51] Int. Cl.[3] ..... B41N 1/24; B41F 15/04; B05C 17/06

[52] U.S. Cl. ..... 101/127; 101/115; 101/126

[58] Field of Search ..... 101/114, 126, 127, 128.1, 101/115

[56] References Cited

U.S. PATENT DOCUMENTS

| | | | |
|---|---|---|---|
| 234,492 | 11/1880 | Ream | 101/127 |
| 429,734 | 6/1890 | Mullaley | 101/127 |
| 659,535 | 10/1900 | Lankford | 101/115 |
| 737,945 | 9/1903 | Lundeberg | 101/115 |
| 754,581 | 3/1904 | Magnus | 101/115 |
| 1,619,587 | 3/1927 | Schoger | 101/114 |
| 1,808,986 | 6/1931 | Hunter | 101/127 |
| 2,816,811 | 12/1957 | Tillett | 101/115 |

*Primary Examiner*—Clyde I. Coughenour
*Attorney, Agent, or Firm*—James B. Middleton

[57] ABSTRACT

A dye printing system for multi-color patterning or pile face sheet materials, such as tufted carpet, includes a stencil, in which the pattern elements are formed by divider walls extending perpendicularly to the plane of the sheet material. The stencil is lowered into contact with the pile face of the sheet material and its divider walls penetrate between the face pilings and rest on the base of the material, and isolate neighboring areas of pile face material from one another, so that print paste can be applied to the pilings within a pattern element without bleeding into neighboring pattern elements. Mechanical means raise and lower the stencil on to the pile face sheet material, and a dye liquor drip catching canopy is passed between the sheet material and the stencil whenever the stencil is raised to protect the sheet material from possible drip contamination. The sheet material is loaded on a rack-mounted platform, moved with the platform to the printing position beneath the stencil, and after the printing step, moved with the platform to an unloading position. A flybridge is suspended over the stencil, so that operators can position themselves conveniently and quickly at any position over the stencil to apply the dye liquor.

2 Claims, 7 Drawing Figures

RUG PRINTING SYSTEM

This application is a continuation of application Ser. No. 919,862, filed June 28, 1978, now abandoned.

BACKGROUND OF THE INVENTION

Multi-color patterned area rugs, wall rugs and other pile face materials have met with increasing commercial success, in the United States in the past few years. Traditionally such products are associated with various weaving processes using predyed yarns. Generally, skilled operators are required for these processes, productivity is low, and the products are expensive. In the tufting industry products of this kind are currently manufactured by means of the manually operated tufting gun, and in recent times by single and double needle control broadloom tufting machines. With single needle machines, although productivity is low and the products are expensive, a few companies have been able to make a commercial success of the operation. With double needle machines, productivity is high, but, in relation to the investment, the productivity traditionally associated with broadloom tufting is low. Even so, in the context of area rugs, these machines are capable of producing a limited variety of styles, at rates exceeding the capacity of the market for them. For these reasons these machines have not realized the future predicted for them.

Within the past fifteen years or so a very large carpet printing industry have grown up within the tufting industry. The carpet printing industry is geared, largely to broadloom manufacture and is not especially suitable for the pattern flexibility, variety of carpet textures and pattern sizes traditionally associated with high quality area rugs. Moreover, the capital investment incurred by these printing machines can only be generated by the enormous productivity of the broadloom industry.

There are numerous methods used for dye printing piled sheet materials, such as carpets, towels, animal furs and the like. These printing methods include flat screen printing, rotary screen printing, raised pattern roller printing, and "deep dye" printing and the Militron process.

The flat screen methods involve the use of screens which contact the surface of the sheet material. The dye pastes are applied to the top surfaces of the screens and forced through holes in the screens by magnetic squeegies, sponges or by suction from behind the sheet material. The screens are impenetrable in some areas and penetrable in the pattern areas where it is desired that dye pass to the sheet material.

The rotary screen is an adaptation of the flat screen, where the screen is formed in the shape of a cylinder. Roller processes involve the use of cylinders with patterned dye area raised out of the cylinder. The cylinders pick up dye on the faces of the raised dye area and transfer the dye to the sheet material, according to the pattern of the dye area, by rolling over the sheet material as the material moves along its length through the machinery.

The screen and roller processes are capable of printing low pile materials such as materials having pile in a quantity of about 8–14 oz./sq. yd., but they usually lack the ability to produce satisfactory results on heavier, high pile materials, as there is insufficient dye material passing through the screens and insufficient force exerted on the dye material to satisfactorily penetrate heavier weights of pile facing.

In the screen and roller dyeing processes, a separate screen or roller is required for each different color. This makes multi-color processes somewhat expensive, both because of duplication and because of mechanization and precision needed to index the separate color patterns. Another disadvantage of these processes is that they are limited in their pattern size, thus requiring several pattern components to form a single large sized pattern as might be associated with an area rug.

The "deep dye" process offers a method of applying all the colors of a pattern to the sheet material simultaneously. In this system, the printing stencil, comprising partitioning built up on a plate so as to form trough-like pattern elements into which various colors of dye solution is fed, is pressed mechanically upwardly against the downwardly facing pile of the sheet material. The equipment for performing the deep dye process is expensive to manufacture and to operate.

The Militron process is one uniquely capable of printing broadloom carpeting and area rugs. The process is based on the simultaneous injection of several colors of dye solution from a matrix of fine nozzles. Those nozzles in the matrix, which fall within the particular element of the pattern to be printed, are controlled so that they all pass the same color of dye solution together. The device is computer controlled, and the pattern is readily changed. The machine involves high capital investment and is not generally available; it is also, as far as known, limited to a comparatively narrow range of carpet pile textures.

SUMMARY OF THE INVENTION

The present invention comprises a method of printing sheet matrials which alleviates many of the aforementioned difficulties as they apply to area rug printing associated with screen, roller and other types of dye printing apparatus. The invention also comprises a novel pattern stencil and print substrate handling platform used in the printing method. The process works successfully on both low and high pile face materials. Multi-color printing can be accomplished in one application, without bleeding, by using a single pattern stencil, thus circumventing the need to use a stencil for each color application as applied in "silk" screen printing processes. Also the pattern stencil can be built to the size of the material to be printed thus eliminating the need and indexing complications of having to use several stencils to build up the pattern.

The pattern stencil of the present invention comprises a plurality of divider walls suspended within a frame. These walls define the individual color areas of the pattern. The walls of the stencil assembly are suspended in the open space within the frame and are supported by a wire matrix extending from the frame.

Typically area rugs are made in sizes of six by nine feet and nine by twelve feet, and for printing them, the pattern stencils of the present invention are made commensurate with these sizes. The printing platform and rack of the present invention would also have to be commensurate in size, so that each rug size would require commensurate printing apparatus. Other, larger or smaller rug sizes can also be printed and these too would require commensurate printing apparatus. Alternatively a large stencil can be build comprising two or more small rug patterns set side by side thus permitting printing of two or more small rugs at one time. Additionally in printing large area rugs—6′×9′ and up—the distance across the stencil are too great for the reach of the operators handling the print paste dispensing guns; to overcome this difficulty and also to optimize the conditions of application, a fly-bridge is provided for each printing apparatus. The fly-bridge comprises a motorized platform bridging the stencil and mounted on wheels which run on tracks laid down on the floor on both sides of the printing apparatus. Swivel seats, which also can be easily moved transversely along the length of the fly-bridge on rails, are furnished for the operators so that they can move freely to any position over the platform. The operators can also drive the fly-bridge back and forth along the length of the stencil and are thus able to position themselves with little expenditure of effort over any desired locality of the stencil. While seated on the fly-bridge the operators can also control operation of the entire printing apparatus In application, the stencil is suspended horizontally by mechanical means, by which it can, as needed, be raised and lowered over a printing platform. The platform is rack mounted so that it can be moved transversely along the rack to three basic positions: the loading position, the printing position and the unloading position. In the loading position, the platform is fully withdrawn from under the stencil, thus permitting the unprinted rug to be precisely mounted on the platform with its pile face up. The accurate fitting of the rug on the platform is achieved by aligning the edges of the rug with the edges of the platform or with marks on the platform surface. The platform is then moved along the rack to the printing position where the rug is vertically aligned beneath the stencil. Precise fitting of the rug on the platform during loading is thus the means of properly positioning the rug beneath the stencil for accurately printing the rug. The stencil is lowered on to the rug during printing and afterwards raised again, and the platform, now carrying the printed rug, is moved further along the rack to the unloading position where the rug is removed. The empty platform is now returned to the loading position in readiness for another printing cycle. When the platform moves from the loading position to the printing position, it passes under a fixed or rotary doctor blade, which fluffs up the pile face of the rug, and removes whatever pile disorientation may have taken place in handling and loading the rug. Also, whenever the stencil is raised and before the platform can be moved transversely, into or out of the printing position, a canopy extends automatically beneath the stencil, between the stencil and the rug on the printing platform, to shield the rug from possible print paste drippings from the raised stencil.

The process performed by the printing assembly of the present invention includes the steps of moving the sheet material mounted in printing index on a movable platform into the printing zone, lowering the stencil onto the sheet material where the walls of the stencil penetrate between individual face piles of material and make edge contact with the sheet material backing, thus preventing paste from bleeding between areas of different color and also insuring printing of all the face piles by not incurring matting down of fibers under the stencil elements. The print paste is applied to the material by holding a dispensing nozzle in the vicinity of the sheet material below the height of the walls of the stencil and by dispensing the desired color of dye liquor onto the piles located in the area between adjacent walls. After printing, by the present invented process, has been completed, the stencil is raised off the sheet material and the canopy is immediately moved into position above the platform area between the sheet material and the stencil in order to catch any drippings of excess print paste from the stencil.

Therefore, it is an object of this invention to provide an uncomplicated dye printing process requiring only one printing stencil for multi-color printing.

Another object of this invention is to provide a dye printing process which will work successfully on both low and high pile sheet material.

A further object of this invention is to provide an economical method of expediently producing intricately printed multi-color piled sheet material.

These and other objects of the invention will become apparent from reference to the following description, attached drawings and appended claims.

DETAILED DESCRIPTION

Figure 1:
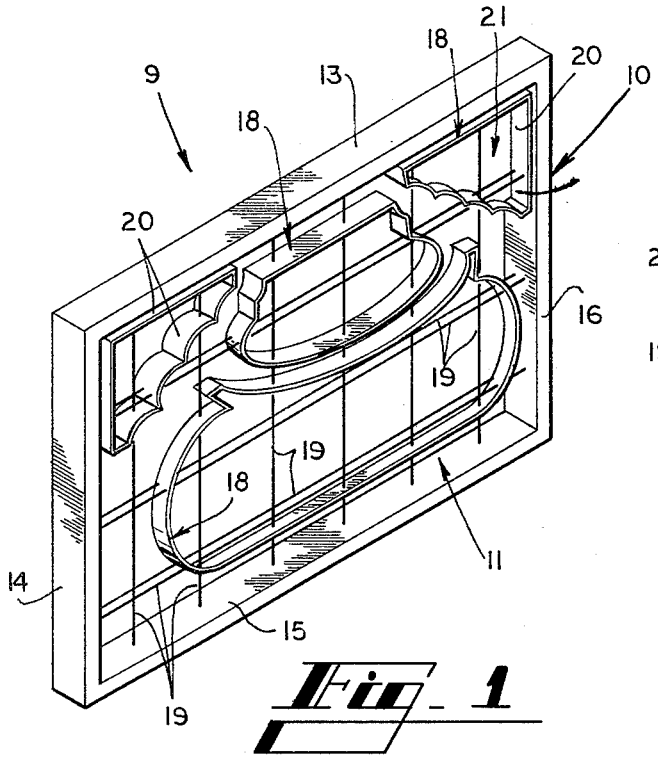
FIG. 1 is a perspective view of a stencil of the present invention standing on its edge.

Referring in more detail to the drawings in which like components have like numerals throughout the several views, FIG. 1 shows a stencil assembly which includes a stencil 9 as used in the present invention. The stencil 9 includes a rectangular frame 10 having four sides 13, 14, 15, 16. The frame 10 encircles an empty space which shall be referred to as the pattern space 11. A number of various shaped stencil elements 18 are arranged in the pattern space 11 within the rectangular frame 10 in such a manner as to collectively define, in conjunction with the stencil frame 10 and the pattern space 11, a desired coordinated design pattern.

Figure 2:
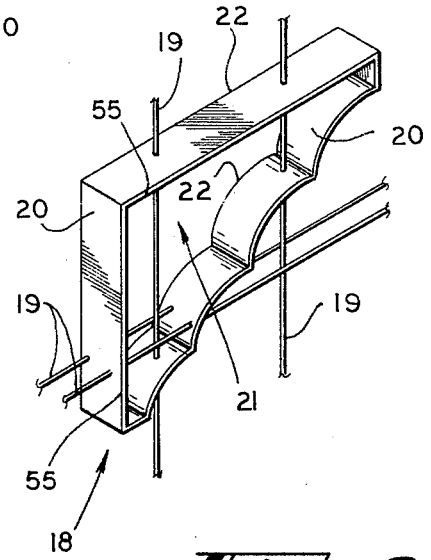
FIG. 2 is a perspective view of one stencil element of the stencil of FIG. 1.

As illustrated in FIG. 2, each stencil element 18 comprises a plurality of divider walls 20 connected together and defining an encircled space 21. The encircled space 21 is part of the previously mentioned empty pattern space 11. The sections of empty pattern space 11 which are not definable as encircled spaces 21 shall be referred to as unencircled pattern space 11. The stencil elements 18 are supported inside the frame 10 by wire elements 19 running between opposite sides 13,15 and 14,16 of the frame 10 in a crossing matrix configuration. The wire elements 19 are spaced apart and serve to support the stencil elements 18 and to hold the stencil elements 18 in their correct positions relative to other stencil elements 18 and to the frame 10. Depending on the intricacy of the design, it may be necessary in some circumstances to put a double row of wire elements 19 in some places, one above the other. If only one row of wire 19 is used, it is desirable that the wire be located below the center of the divider walls 20 in order to obtain the best vertical stability. The invention, however, is not to be limited by this recommendation.

The wire elements 19 are pulled tight so that sagging of the stencil elements 18 will be minimized within the pattern space 11. The border walls 20 and stencil elements 18 are maintained in their proper positions in the frame by being fastened to the wires in a manner that prevents the stencil elements from moving along the wires. This can be done, for example, by tacking the wire directly to the stencil with soldering or like means, or by soldering a knot on the wire on each side of the wall 20. Where two perpendicular wires 19 cross one another, they can be tacked together.

Figure 3:
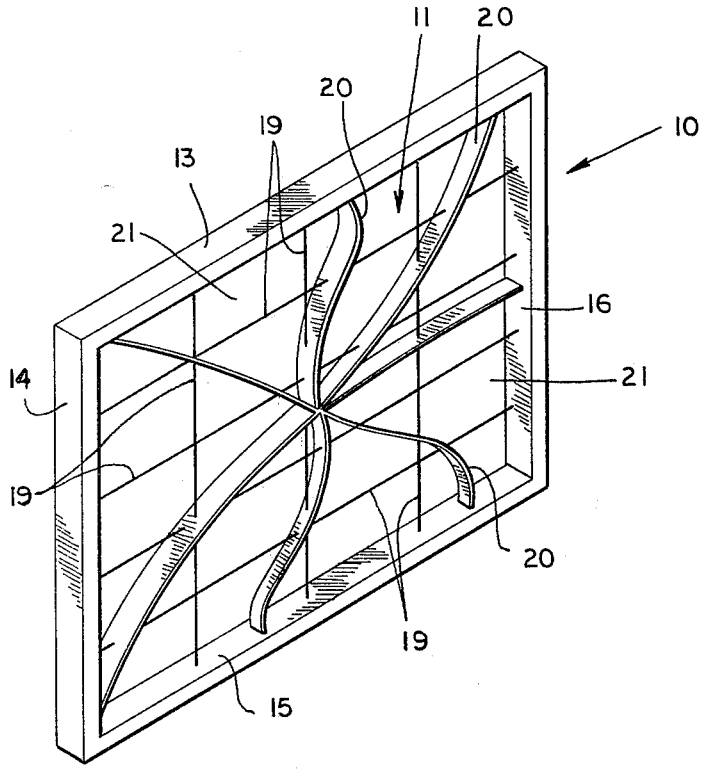
FIG. 3 is a perspective view of a stencil of FIG. 1 but displaying a different design pattern.

As shown in FIG. 3, it is not always necessary that the divider walls 20 be formed into individual stencil elements 18. It is also the teaching of the present invention to interconnect the divider walls 20 with one another and with the sides 13,14,15,16 of the stencil frame 10. In this way, the pattern space 11 is, likewise, divided up into a series of encircled spaces 21. Wire elements 19 are again used to support the walls 20 as they span the pattern space 11.

Figure 5:
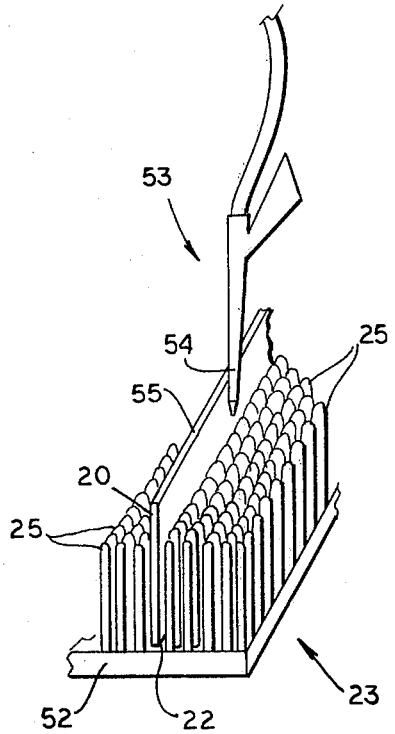
FIG. 5 is an isolated view showing a stencil wall of the invented stencil assembly positioned on the sheet material.

The lower edges 22 (see FIGS. 2, 4 and 5) of the walls 20 are located in a common plane parallel to the plane defined by the stencil frame 10. The divider walls 20 extend perpendicular to this same common plane.

Figure 4:
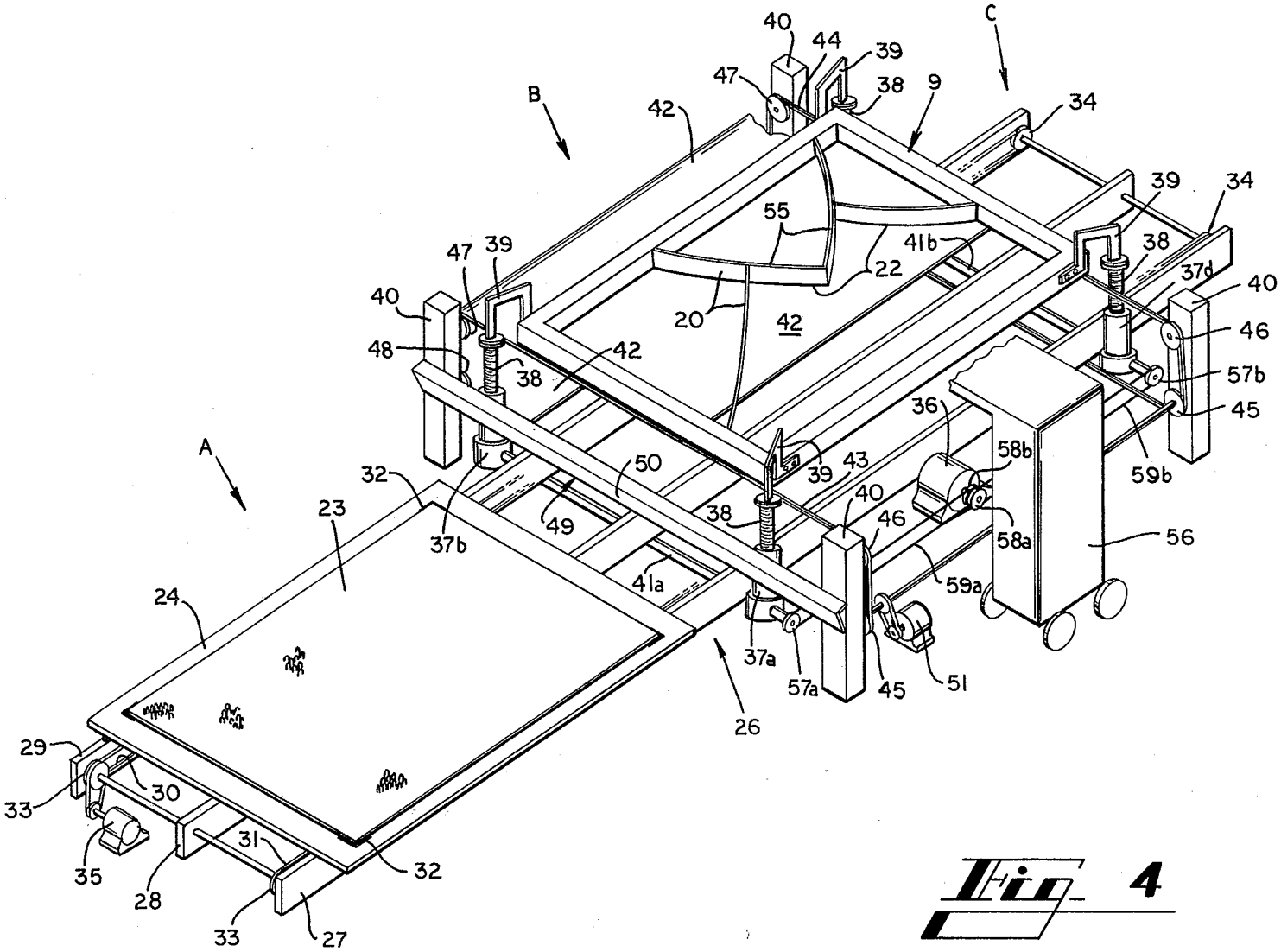
FIG. 4 is an exploded perspective view of the printing apparatus of the invented printing system including the printing platform, stencil and fly-bridge.

FIG. 4 illustrates the printing apparatus associated with the present invention. The printing apparatus comprises a platform 24 movably mounted on an elongated stationary rack 26 including three parallel rails 27, 28, 29. A rug 23 is shown as placed on the top surface of the platform 24. The platform 24 displays indexing or positioning marks 32 on its top surface and has wheels (not shown) mounted on its underside which run along the upper edges of the rails 27, 28, 29 of the rack 26. Chains 30, 31 encircle the rack 26 lengthwise and connect at opposite ends of the platform 24. At each end of the stationary rack 26, the chains 30, 31 pass over sprockets 33, 34. One set of sprockets are driving sprockets 33 operated by an electric platform motor 35.

One end of the rack 26 shall be referred to as the platform loading zone A and the opposite end of the rack shall be referred to as the platform unloading zone C. The printing zone B of the platform is located toward the unloading end C. Four mechanically coordinated motorized jacks 37*a*, 37*b*, 37*c* (not shown), 37*d*, having screw elements 38 are located in the printing zone B of the apparatus and define a rectangular area slightly wider than the platform 24. Each jack 37 is oriented so that the screw element 38 extends perpendicular to the platform 24. The four motorized screw jacks 37*a*, 37*b*, 37*c*, 37*d* are all operated simultaneously by the same jack operating motor 36 in order that movement of the four jacks can be coordinated. Two jacks 37*a*, 37*b* are connected by rotatable shaft 41*a*. Two jacks 37*c*, 37*d* are connected by rotatable shaft 41*b*. The shafts 41*a*, 41*b*, when rotated operate the screw elements 38 of the respective jacks 37. A driven pulley 57*a* is attached to an extension of shaft 41*a* and a driven pulley 57*b* is attached to an extension of shaft 41*b*. Two drive pulleys 58*a*, 58*b* are attached to the shaft of jack motor 36 and each set of drive pulleys and driven pulleys 57*a*, 58*a* and 57*b*, 58*b*, respectively, is connected by a timing belt 59*a*, 59*b* surrounding the two pulleys. Through this arrangement, the four jacks are operated in mechanized coordination. Four canopy stands 40 are positioned about the printing zone B with one stand 40 located near each of the jacks 37. The four canopy stands 40 support a canopy mechanism which comprises a canopy 42 attached to two canopy supporting chains 43, 44, each of which is carried by and extends about four sprockets 45, 46, 47, 48. The driving sprockets 45 are simultaneously driven by an electric canopy motor 51. The canopy supporting chains 43, 44 are located so as to encircle the rack 26 perpendicular to the rack rails 27, 28, 29 with the upper portion of the canopy supporting chain being higher than the level of the platform 24. To give strength to canopy 42 and prevent it from sagging, rigid tubing (not shown) is extended between and connected to the two supporting chains 43, 44 and attached to the canopy. A doctor blade 49 is mounted across the two canopy stands 40 nearest to the loading zone A and on the side of the canopy stand facing the loading zone. The blade 49 is parallel to the plane of the rug 23 and platform 24 and is adjustable in height along the stands 40 and relative to the rug 23. This doctor blade 49 is, in the present embodiment, a steel angle, one flange 50 of which extends downwardly into contact with the fibers 25 of the rug 23.

The printing method proceeds as follows: A stencil 9 having elements as previously described, is assembled to represent the desired design pattern and is made as large or small as necessary to fit the size of the rug 23, or like material, to be printed. A stencil bracket 39 is fastened to each corner of the stencil 9. Each bracket 39 is formed so that it can reach over the canopy supporting chain 43 or 44 and sit on top of the screw element 38 of its respective jack 37. The brackets 39 avoid contact with the chains 43, 44 even when the jacks 37 are lowered to position the stencil 9 on the platform 24. The stencil 9 is then placed in position in the printing zone B with each of the four brackets 39 at the corners of the stencil resting on one of the jack screws 38. The screws 38 are fully extended so as to hold the stencil high above the rack 26. The canopy 42 is in its extended position above the rack 26 and below the stencil 9. The rug 23 (see FIG. 4) is placed on the platform 24 in the loading zone A with carpet pile face 25 facing up from the platform 24. The rug 23 is accurately positioned on the platform 24 by an appropriate indexing system. For example, in the disclosed embodiment, the rug 23 is aligned with indexing marks 32 on the platform to insure proper positioning on the platform.

The electric motor 35 is activated and the platform 24 and rug 23 are pulled by chains 30, 31 from the loading zone A into printing position under the stencil in the printing zone B. The platform 24, with the rug 23 accurately positioned on the platform, is stopped in the printing zone B at a printing position where the rug is in proper vertical alignment with the stencil 9. Since the printing position of the platform 24 is automatically controled, as later described, and since the stencil 9 moves in a fixed vertical plane, the proper vertical alignment between rug 23 and stencil 9 is achieved by accurately placing the indexing marks 32 on the platform relative to the fixed vertical alignment of the stencil over the platform when the platform is in the printing position, and then aligning each rug on the indexing marks 32 each time a rug is placed on the platform. As the rug 23 enters the printing zone B, doctor blade 49 engages the face pile 25 with the extending flange 50 and fluffs up the piles as they pass by and makes them stand vertically so as to facilitate proper positioning of the divider walls 20 between the piles.

Once the platform 24 and rug 23 have been moved into position in the printing zone B, the canopy motor 51 is switched on and the canopy 42 is retracted to its position underneath the rack 26. The stencil 9 is lowered onto the rug 23 so that the walls 20 pass beneath the individual piles 25 until finally, the lower edges 22 of the divider walls 20 make contact with the rug backing 52 (see FIG. 5). The individual piles 25 are segregated to either one side or the other of the divider wall 20 so as to create a well defined separation between piles of adjacent encircled areas 21. The great majority of piles 25 will take up positions on one side or the other of the divider walls 20, but it is expected that some of the piles 25 may become trapped below the walls 25. The lowering (and subsequent lifting) of the stencil 9, in the disclosed embodiment, is accomplished by the retraction (and extension) of the four jacks 37. The four stencil brackets 39 are rigidly connected to the stencil 9, but are not connected to and only rest on the jack screws 38, so that the jacks 37 continue to retract, leaving the stencil resting on the rug 23.

After the stencil 9 has been properly positioned on the rug 23, print paste is applied to the rug pile face 25 according to the color scheme of the design pattern. Each different encircled space 21 and the unencircled pattern space 11 may receive a different color or treating agent, or may be left uncolored. The print paste, in the preferred method, is applied by spray dispensers 53 (see FIG. 5) which are hand held by operators positioned on a movable flybridge 56 suspended above the platform area. The nozzle end 54 of the spray dispenser 53 is held below the upper edge 55 of the divider wall 20 and moved about between adjacent divider walls 20. In this way, the print paste meant for pile face fibers 25 on one side of a divider wall 20 will not flow over to those on the other side. The term "print paste" of the present invention is meant to be a generally inclusive term encompassing dyes, resists and other treating agents of varying colors and viscosities.

Once the print paste has been fully applied, the stencil 9 is lifted from the rug 23 and canopy 42 is immediately moved back into place between the carpet and stencil to catch any drippings which may fall from the stencil 9. The platform 24 now carrying the printed rug 23 is moved further along the rack 26 by the motor 35 and chains 30, 31 to the unloading zone C. Here, the rug 23 is removed from the platform 24 and the platform is returned to the loading zone A by reversing the directional mode of the motor 35.

Figure 6:
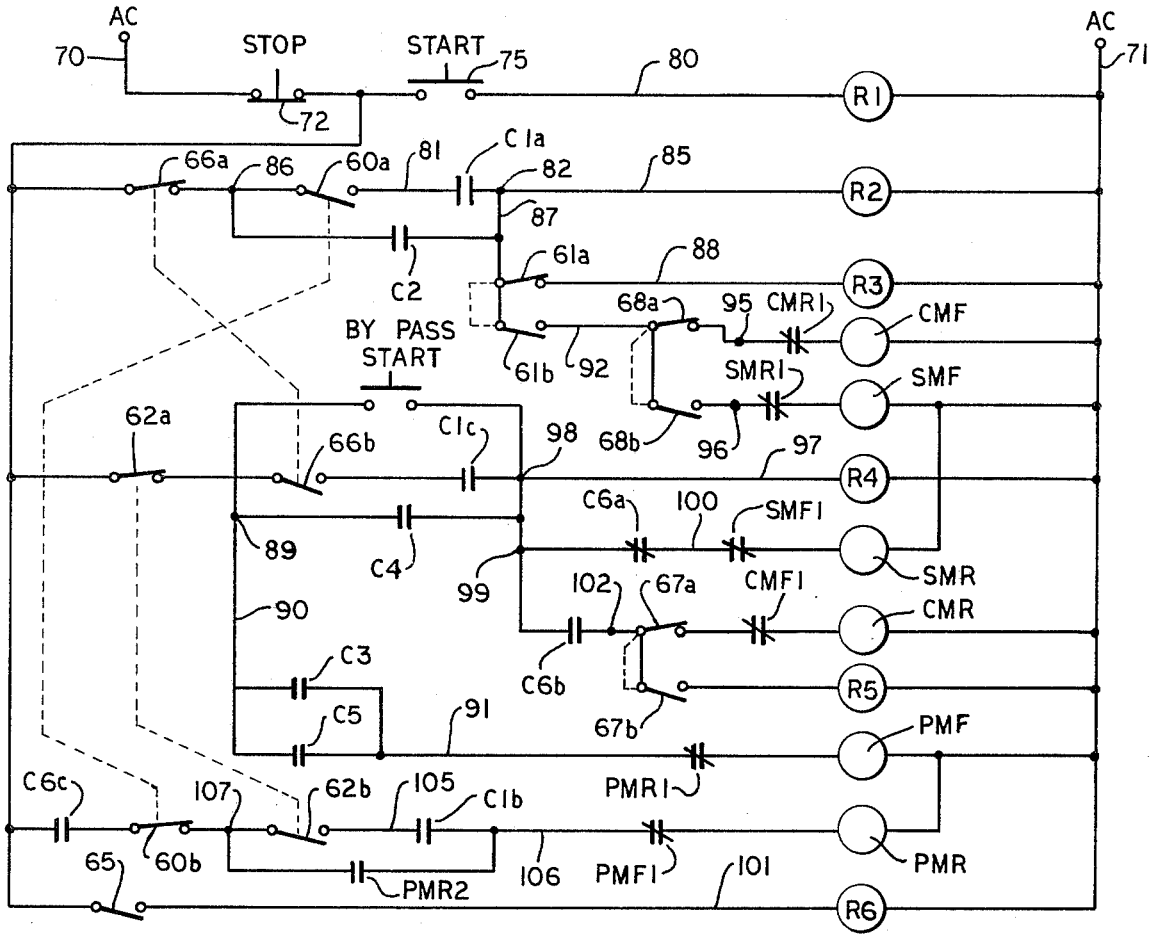
FIGS. 6 and 7 are schematic diagrams of the electrical control circuit of the invention.
Figure 7:
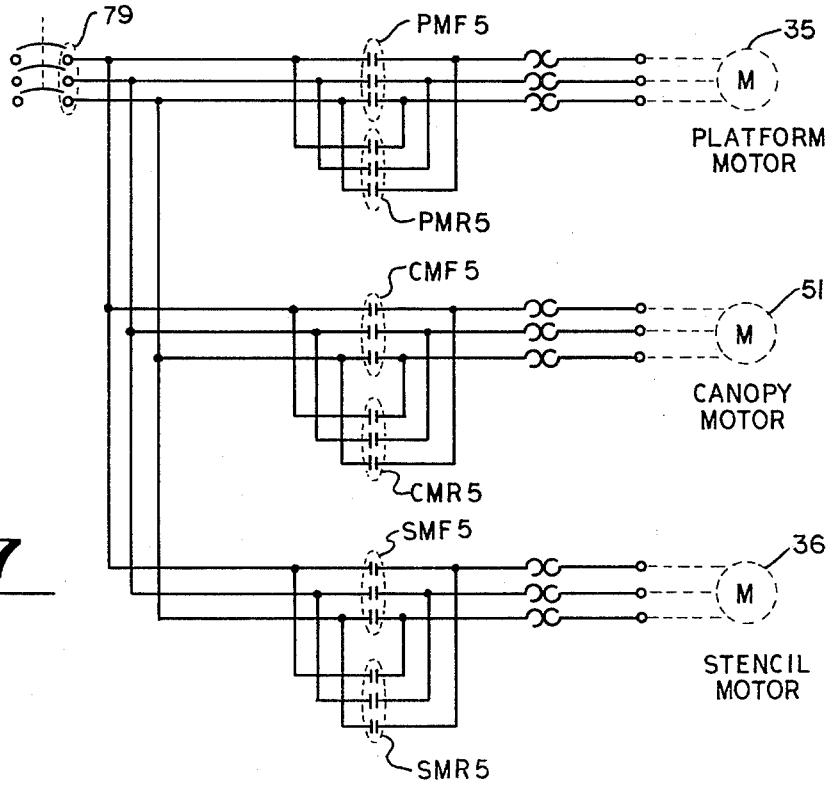

The circuitry controlling the movement of the platform 24, canopy 42 and stencil 9 of the present invention is shown in FIGS. 6 and 7. FIG. 7 shows the platform motor 35, canopy motor 51, and jack operating motor 36 which shall hereinafter be referred to as stencil motor 36 for ease of understanding. As will be obvious to those skilled in the art from inspection of FIG. 7, the motors 35, 51, and 36 of the preferred embodiment are driven by a three-phase 230 volt source indicated by the three lines noted as 79. As may further be seen from FIG. 7, platform motor 35 may be operated in one direction by closing a set of three contacts shown as PMF5, and the other direction by closing a set of contacts PMR5. Likewise, canopy motors 57 may be run in a first direction by contacts CMF5 and in a reverse direction by contacts CMR5. Also stencil motor 36 may be operated in a first direction by contacts SMF5 and in the opposite direction by SMR5.

The control logic circuitry of the present invention is shown in FIG. 6. It is to be noted that the circuitry includes a number of relays whose coils are designated as R1, R2, R3, R4, R5, R6, CMF, CMR, SMF, SMR, PMF, and PMR. The designations for the relay coils shown in FIG. 6 have been selected to aid in understanding their function. Coils R1–R6 activate relays which are internal to the control system shown in FIG. 6. Relay coil PMF corresponds to "platform motor forward" and PMR corresponds to "platform motor reverse". Likewise coils CMF and CMR correspond to coils controlling the forward and reverse movement of the canopy motor 51, respectively, and coils SMF and SMR control the stencil motor 36.

In order to understand the operation of the control circuitry it must be understood that contacts PMF5 shown in FIG. 7 are closed upon the excitation of coil PMF shown in FIG. 6. Similarly contacts PMR5 shown in FIG. 7 are closed by the excitation of coil PMR shown in FIG. 6. Likewise contacts CMF5 are closed by excitation of coil CMF; contacts CMR5 are closed by excitation of coil CMR; contacts SMF5 are closed by excitation of coil SMF; and contacts SMR5 are closed by excitation of coil SMR.

It should be further understood that contacts C1A and C1B are closed by excitation of coil R1 as shown in FIG. 6 and in a similar manner contact C2 is closed by excitation of coil R2. It can therefore be seen that in FIG. 6, contacts denoted as CX where X is an integer are closed by excitation of a coil RX where X is the same integer. Also contacts noted as PMFX are closed by coil PMF; contacts noted as PMRX are closed by excitation of coil PMR; contacts noted as CMFX are operated by excitation of coil CMF; contacts noted as CMRX are operated by excitation of coil CMR; contacts noted as SMFX and SMRX are operated by excitation of coils SMF and SMR respectively.

A control circuit shown in FIG. 6 also includes seven limit switches which are activated by the mechanical movements of the platform 24, canopy 42, and stencil 9. All limit switches with the exception of switch 65 are two pole single throw switches. Switches **60*a* and 60*b* are mechanically activated when the platform 24 is in its loading position in the loading zone A. Switches 61*a* and 61*b* are mechanically activated when the platform 24 is at its printing position in printing zone B and switches 62*a* and 62*b* are mechanically activated when the platform 24 reaches its unloading position in unloading zone C. Similarly switch 65 is operated when the stencil 9 is in its up position and switches 66*a* and 66*b* are operated when the stencil is in its down position. Switches 67*a* and 67*b* are mechanically activated when the canopy 42 is in its extended position above the rack 26 and switches 68*a* and 68*b* are mechanically activated when the canopy is in its retracted position below the rack 26**.

The arrangement of the control circuitry shown in FIG. 6 is such that its operation may be conveniently explained by defining three cycles. The first cycle is initiated when the platform 24 is in its loading position with a rug 23 loaded thereon. Therefore switch **60*a* is closed and switch 60*b* is open at the beginning of the first cycle. Depression of start button 75 completes a circuit through lines 80 and excites coil R1. The excitation of coil R1 closes contacts C1 thus completing a circuit between points 81 and 82 which completes a circuit through switches 66*a* and 60*a* to line 85 thus exciting coil R2. The excitation of coil R2 closes contact C2 completing a circuit between points 86 and 82. As will be obvious to those of ordinary skill in the art, the closing of contact C2 will latch coil R2 when switch 60*a*** opens in response to the platform moving from its loading position and contact C1*a* opens when start switch 75 is released thereby maintaining the excited state of coil R2 until some other interruption to its holding current occurs.

The closing of contact C2 also completes a circuit between point 86 and point 87 which provides excitation to coil R3 through switch 61*a* and line 88. The excitation of coil R3 closes contact C3 and completes a circuit through switch 62*a* to point 89, along line 90 to line 91 and thus exciting coil PMF.

The excitation of coil PMF closes contact PMF5 (shown in FIG. 7) thus operating platform motor 35 and causing forward movement of the platform 24 from its loading position towards its printing position. Recall that since contact C2 latches coil R2 thus assuring prolonged excitation of coil R3, contact C3 will remain closed and thus maintain holding current on coil PMF until switch 61*a* opens causing coil R3 to become deenergized. When the platform reaches its printing position, switches 61*a* and 61*b* are mechanically tripped so as to be opened and closed respectively. The opening of switch 61*a* deenergizes coil R3, thus opening contact C3 and terminating the energized state of coil PMF. This stops operation of platform motor 35. The closing of switch 61*b* completes a circuit from point 87 to line 92 on to point 95 thus exciting coil CMF. The excitation of coil CMF closes contacts CMF5 (shown in FIG. 7) causing canopy motor 36 to become activated and begin retracting the canopy 42. Furthermore the excitation of coil CMF opens normally closed contacts CMF1 thus preventing excitation of coil CMR. The system remains in this state until the canopy 42 has been retracted to the point where it mechanically triggers limit switches 68*a* and 68*b*. When the canopy reaches its fully retracted position, switches 68*a* and 68*b* are opened and closed respectively. The opening of switch 68*a* opens the circuit between points 92 and 95 and thus deenergizes coil CMF. The closing of switch 68*b* completes a circuit between points 92 and 96 thus energizing coil SMF.

The excitation of coil SMF closes contacts SMF5 (shown in FIG. 7) thus lowering the four jacks 37 and lowering the stencil 9. Also the excitation of coil SMF opens normally closed contacts SMF1 preventing excitation of coil SMR. When the stencil reaches its printing position, it mechanically opens limit switch 66*a* and closes limit switch 66*b*. The opening of switch 66*a* terminates the connection between line 70 and point 86, thus deenergizing coil R2, which causes contact C2 to open and therefore maintains coils R2, R3 CMF and SMF in their unexcited states. This completes the first cycle of operations and the control circuit is in a stable state.

Once printing of the rug 23 has been completed, depression of start switch 75 will begin the second cycle of operation of the control circuit. The depression of start switch 75 again energizes coil R1 thus closing all contacts associated therewith. However, limit switch 66*a* is open, and therefore the closure of contacts C1*a* in response to the excitation of coil R1 will not energize coil R2. However the excitation of coil R1 closes contacts C1*c*. As may be seen from FIG. 6, the closure of contacts C1*c* completes a circuit through switch 66*b* (which is closed due to the down position of the stencil) and switch 62*a* to line 97 and thus energizes coil R4. The excitation of coil R4 closes contact C4 thus completing a circuit between point 89 and point 98 and thereby latching coil R4. As may be seen from the foregoing, the latching of coil R4 in response to the closure of contact C1*c* at the beginning of the second cycle of the control circuit operation is similar to the latching of coil R2 in response to the closure of contacts C1*a* at the beginning of the first cycle of the control circuit operation.

Closure of contact C4 also completes a circuit between points 89 and points 99 to line 100 thus exciting coil SMR. The excitation of coil SMR opens normally closed contacts SMR1 preventing excitation of coil SMF and furthermore closes contacts SMR5 (shown in FIG. 7) thus causing stencil motor 36 to begin raising of the stencil by raising of the four jacks 37. The control circuit remains in this state until the stencil 9 reaches its uppermost position closing limit sswitch 65. The closure of limit switch 65 completes a circuit along line 101 which excites coil R6. The excitation of coil R6 both closes contacts C6*b* and opens normally closed contacts C6*a*. The opening of contacts C6*a* deenergizes coil SMR and the closure of contacts C6*b* completes a circuit between point 99 and point 102 through switch 67*a* which allows excitation of coil CMR. The excitation of coil CMR opens normally closed contacts CMR1 thus preventing excitation of coil CMF and furthermore closes contacts CMR5 (shown in FIG. 7) thus causing canopy motor 51 to begin retraction of the canopy 42. The circuitry remains in this state until the canopy reaches its extended position thus mechanically opening limit switch 67*a* and closing limit switch 67*b*. The opening of switch 67*a* deenergizes coil CMR and the closing of switch 67*b* energizes coil R5. The excitation of coil R5 closes contact C5 completing a circuit from point 89 along line 90 through contact C5 to line 91 thus energizing coil PMF. The excitation of coil PMF opens normally closed contacts PMF1 preventing excitation of coil PMR and also closes contacts PMF5 (as shown in FIG. 7) causing platform motor 35 to move the platform 24 from its printing position to its unloading position. The control circuit remains in this state until the platform reaches its unloading position thus mechanically opening limit switch 62*a* and closing limit switch 62*b*. The opening of switch 62*a* deenergizes coil R4, thus opening contacts C4 and preventing excitation of coils SMR, CMR, and R5. The loss of holding current on coil R5 opens contact C5 terminating holding current to coil PMF and thus terminating operation of platform motor 35. The control circuit is now in a stable state and has completed its second cycle of operation. As will be apparent from the foregoing description, the stencil 9 is in its upper position, the canopy 42 is in its extended position and the platform 24 is at its unloading position.

In the third cycle of operation of the control circuitry it is only necessary to move the platform from its unloading position in unloading zone C all the way back to its loading position in unloading zone A. Depression of start button 75 energizes coil R1 thus closing contact C1*b*. The simultaneous closure of contacts C1*a* and C1*c*, also effected by depression of button 75, will not energize any of the other relay coils since limit switch 60*a* is open and 60*b* is closed due to the stencil 9 being in its upper position and limit switch 62*a* is open and 62*b* is closed due to the platform 24 being in its unloading position. Depression of start button 75 also energizes coil R6 through limit switch 65 which is closed as a result of the stencil 9 being in its upper position. Excitation of coil R6 closes contacts C6*c*. The closure of contact C1*b* completes a circuit through contacts C6*c* through switches 60*b* and 62*b* along lines 105 and 106 to coil PMR. The excitation of coil PMR closes contacts PMR5 (shown in FIG. 7) causing platform motor 35 to begin retracting the platform from its unloading position back to its loading positon. The excitaton of coil PMR also opens normally closed contacts PMR1 preventing excition of coil PMF. Furthermore excitation of coil PMR closes contacts PMR2 thus completing a circuit between point 107 and line 106. The closure of contacts PMR2 will provide a circuit for the holding current on coil PMR when limit switch 62*b* is opened by to the platform moving from its unloading position back toward its loading position. The control circuitry will remain in this state until the platform arrives at its loading position thus mechanically opening switch 60*b* and terminating holding current to coil PMR. This completes the third cycle of operation of the control circuitry and the printing apparatus is now in the same state as was described at the beginning of the first cycle.

While this invention has been described in detail with particular reference to preferred embodiments thereof, it will be understood that variations and modifications can be effected within the spirit and scope of the invention as described hereinbefore and as defined in the appended claims.

What is claimed is:

1. A stencil, for use in dye printing pile fabric wherein said stencil is placed against said fabric and at least two different dyes are applied through said stencil to dye said pile fabric, said stencil including a generally rigid frame disposable beyond the area to be printed, a plurality of divider walls within the confines of said frame for separating the pile of said pile fabric, each divider wall of said plurality of divider walls being disposable perpendicularly to said pile fabric and having a lower edge for engaging the backing of said pile fabric, means for supporting said divider walls comprising a first plurality of wires fixed to said frame and extending across said frame in a first direction generally parallel to the plane of said pile fabric, a second plurality of wires fixed to said frame and extending across said frame in a second direction generally parallel to the plane of said pile fabric, said second direction being angularly related to said first direction, each divider wall of said plurality of divider walls being fixed to at least some of said first plurality of wires and said second plurality of wires, and further including a third plurality of wires fixed to said frame and extending parallel to said first plurality of wires, each wire of said third plurality of wires being above one wire of said first plurality of wires, said second direction being generally perpendicular to said first direction.

2. A stencil as claimed in claim 1, each divider wall of said plurality of divider walls having sufficient height to extend above the pile of said pile fabric for separating pattern areas of said pile fabric.

* * * * *